US005846111A

United States Patent [19]

Grimsel

[11] Patent Number: 5,846,111

[45] Date of Patent: Dec. 8, 1998

[54] CONSTRUCTION KIT FOR KITES AND MODEL GLIDERS AS WELL AS PRESENTATION OBJECTS AND SURFACES

[76] Inventor: Wolfgang Grimsel, Wiemkenhofsweg 30, 26125 Oldenburg, Germany

[21] Appl. No.: 911,511

[22] Filed: Aug. 14, 1997

[30] Foreign Application Priority Data

Aug. 20, 1996 [DE] Germany ..... 296 14 367 U
Jan. 4, 1997 [DE] Germany ..... 197 00 192.0

[51] Int. Cl.[6] ..... A63H 27/08

[52] U.S. Cl. ..... 446/61; 446/107

[58] Field of Search ..... 446/107, 108, 446/126, 61

[56] References Cited

U.S. PATENT DOCUMENTS

| | | | |
|---|---|---|---|
| 2,284,458 | 5/1942 | Antwerp | 446/126 |
| 3,132,443 | 5/1964 | Kuhn | 446/126 |
| 3,176,428 | 4/1965 | Slingluff | 446/107 |
| 3,757,430 | 9/1973 | MacBride | 446/107 |
| 3,796,004 | 3/1974 | Auerbach | 446/107 |
| 3,927,489 | 12/1975 | Bernstein | 446/126 |
| 5,070,665 | 12/1991 | Marrin et al. | 446/108 |
| 5,491,950 | 2/1996 | Obegi | 446/126 |

*Primary Examiner*—Robert A. Hafer
*Assistant Examiner*—Jeffrey D. Carlson
*Attorney, Agent, or Firm*—Klaus J. Bach

[57] ABSTRACT

In a construction kit for kites, model gliders, mobiles, or presentation objects or surfaces comprising at least two elastic rod elements and at least one flat flexible material band provided with receiving structures for the rod elements, and strut elements extending between the rod elements, there are provided primary connecting elements for interconnecting rod elements for lenghtening the rod elements and secondary connecting elements for interconnecting the rod elements with the strut elements and with strings.

6 Claims, 4 Drawing Sheets

CONSTRUCTION KIT FOR KITES AND MODEL GLIDERS AS WELL AS PRESENTATION OBJECTS AND SURFACES

BACKGROUND OF THE INVENTION

The invention relates to a construction kit for kites and model gliders as well as mobiles and presentation objects and surfaces.

Conventional kites and model gliders and construction kits for their assembly consist essentially of geometrically fixed frame elements with rigid struts and connectors as well as coverings with a corresponding geometric shape. These kites are practically unalterable in their geometric form. Even the usual assembly systems for more complex kites consist conventionally of a number of individual kites whose geometric form is predetermined. Usually, they all have the same basic shape, which means that the variation potential for the shaping of the complex kite system is similarly very limited.

The object of the present invention is to provide a construction kit for kites and model gliders which comprises a limited, small number of different basic elements with which practically any number of different individual kites and kite systems of the most varied geometric shapes can be constructed. The construction kit should be equally suitable for making mobiles and presentation objects or surfaces.

SUMMARY OF THE INVENTION

In a construction kit for kites, model gliders, mobiles, or presentation objects or surfaces comprising at least two elastic rod elements, at least one flat flexible material band provided with receiving structures for the rod elements, and strut elements extending between the rod elements, there are provided primary connecting elements for interconnecting rod elements for extending the rod elements and secondary connecting elements for interconnecting the rod elements with the strut elements and with strings.

Using this construction kit, it is possible in particular to build a base element with a band-like basic structure which, on one hand, can be constructed in itself to form various secondary structures and, on the other hand, can be combined with further base elements of the same basic structure but possibly different secondary structure to form a wide range of final shapes.

In a preferred embodiment the material band is essentially oblong. This kind of material band is easy and cheap to produce and simple to handle. Suitable materials consist especially of fabrics or plastics, especially those materials which are already used for kites, parachutes and similar objects.

A number of eyelets can be provided in opposite edge areas of the material band for receiving rod elements. In an alternative, particularly advantageous, embodiment pocket structures are provided at opposite edge areas of the material band. They are adapted to receive and hold the rod elements. These pocket structures can be designed as hem ends at the edges of the material band, they can be part of the material band or they may be separate pieces attached to the material, for example, by simply sewing, fixing, or cementing to the band.

In order to guarantee the easiest possible mounting of strut elements and/or connecting elements to the rod elements, there should be apertures, e.g. punched holes or eyelets near the pocket structures for the receipt and/or insertion of strut elements and/or connecting elements.

The connecting elements for joining the rod elements together and those for the mounting the strut elements to the rod elements are preferably of the same type.

According to a particularly advantageous embodiment of the invention, this kind of "universal" connecting element consists of an H-shaped component with two parallel longitudinal bars and one crossbar. Two blind bore holes are provided in the crossbar in a mirror-inverted manner in relation to one another and parallel to the longitudinal bars. A rod element or a strut element can be anchored in each of these blind holes. In the simplest case, the anchoring is based on frictional grip and form locking between the inner wall of the blind hole and the surface of the rod or strut element.

The connecting element consists preferably of elastic material, especially rubber or plastic.

The invention is described below in greater detail on the basis of the accompanying drawings.

DESCRIPTION OF A PREFERRED EMBODIMENT

The design variants shown in the diagrams all relate to kites and model gliders. However, it is easy to see that also mobiles and presentation or advertising displays can be assembled on the basis of the construction kit in accordance with the invention. A special example of this application worth mentioning here is the ribbon in the shape shown in FIG. 2, which can be used as the so-called "AIDS" ribbon in connection with public information campaigns.

Figure 1:
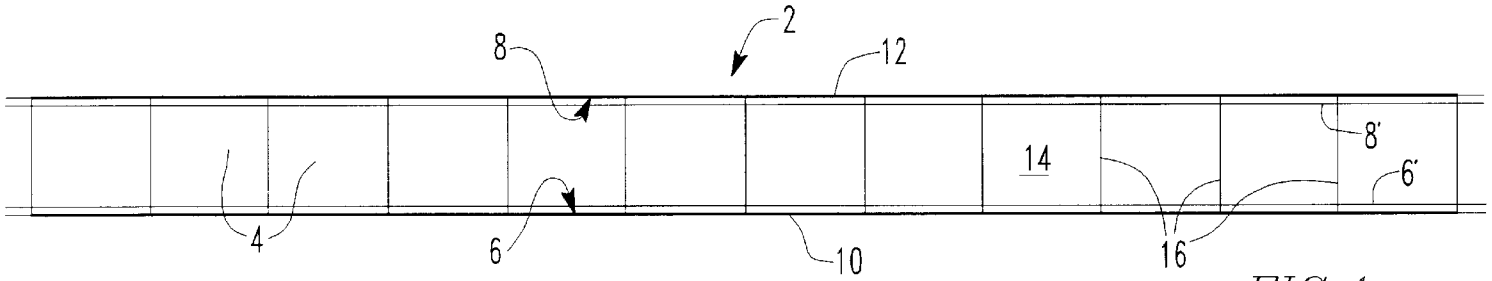
FIG. 1 shows a base element in the band-shaped basic form.

The base element 2 shown in FIG. 1 for kites and flying models consists of an elongated, e.g. approximately 2 meters long, essentially oblong band of material 4, whose two longitudinal edges 6, 8 are each provided with a pocket-type hem formed by seams which are represented in the drawings by lines 6', 8', in each of which one (single or multi-part) rod element 10 or 12 is inserted. The rod elements 10, 12 expediently consist of elastic material with a fair bending strength and good elastic properties.

Figure 9:
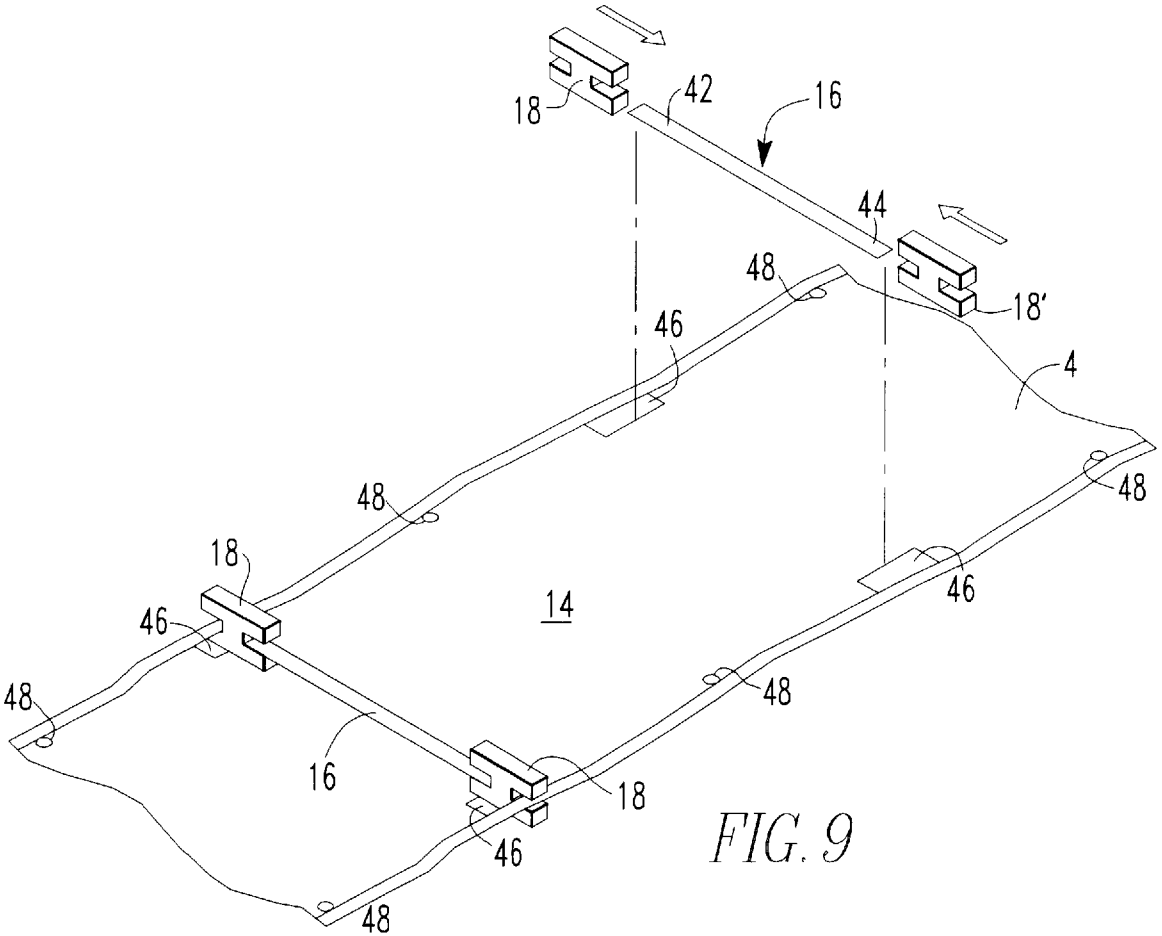
FIG. 9 is a detailed view of a base element in the basic form with apertures and connecting elements in accordance with FIG. 6.
Figure 8:
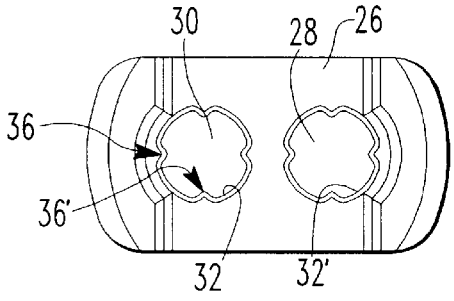
FIG. 8 is a cross-sectional view taken along line VIII—VIII of FIG. 7 and FIG. 6.
Figure 7:
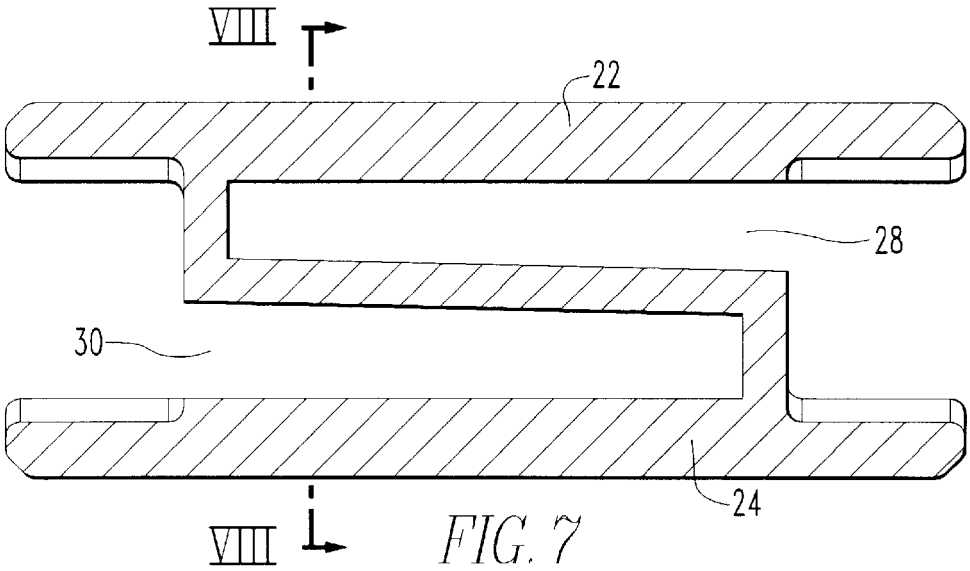
FIG. 7 is a longitudinal cross-sectional view of the connecting element taken along line VII—VII of FIG. 6.

At right angles to the two longitudinal edges 6, 8 and at regular intervals to each other on a surface 14 of the material band 4, several strut elements 16 are arranged, which hold the rod elements 10, 12 spaced apart and thus stretch the material band 4. The strut elements 16 are either directly fixed to the rod elements 10, 12, or, as shown in FIG. 9 in more detail, by means of connecting elements 18. To locally stabilize these mounting structures, apertures 46, 48 are provided in the material band 4 at more or less regular intervals and the strut elements 16 or the connecting elements 18 can be inserted through these apertures and joined to the rod elements 10, 12. Alternatively, or additionally, strings or the ends of rod elements 10, 12 can be fed through the apertures 46, 48. To fix the strut elements 16 or connecting elements 18 to the rod elements 10, 12, the connecting elements 18 as represented in FIGS. 6–8 are used.

Figure 6:
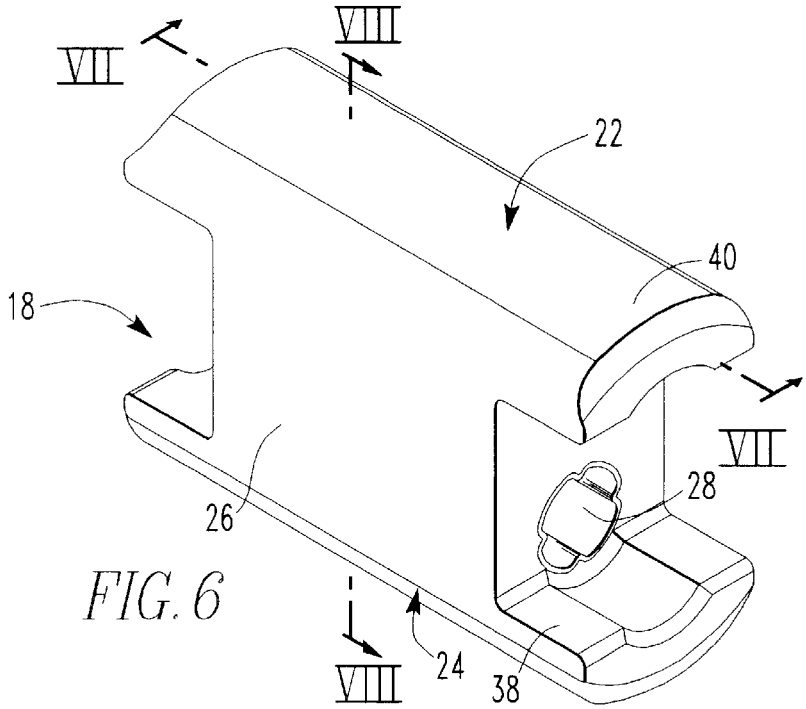
FIG. 6 shows a connecting element in accordance with the invention.

FIG. 6 is a perspective view of the connecting element 18 in accordance with the invention. The connecting element 18 has an "H" shaped basic body with two longitudinal bars 22, 24 and one crossbar 26. The crossbar 26 is provided with two blind bore holes 28, 30 arranged in a mirror-inverted manner in relation to one another and parallel to the longitudinal bars 22,24 (see FIG. 7 and FIG. 8). In each of these blind holes 28, 30, a rod element 10 or 12 or a strut element 16 can be anchored. The anchoring is based in the simplest case on friction grip and form locking between the blind hole inner wall 32 and the surface of the rod element 10 or 12 or the strut element 16. In order to increase the friction grip, lugs or studs 36 can be provided in the inner walls of the blind holes 32.

To fix the strut elements 16 to the elements 10, 12, the connecting elements 18 are passed, as shown in FIG. 9, through the apertures 46 in the material band 4 in such a manner that the longitudinal bars 22, 24 are parallel to the surface 14 of the material band 4, with their ends 38, 40 which protrude beyond the crossbar 26 gripping the rod elements 10 and/or 12 like a pair of tongs. The blind hole 28 or 30 of the connecting element 18, which points towards the material band 4 serves to receive one end 42 of the strut element 16. At the other end 44 of the strut element 16, a second connecting element 18 is arranged in the same manner and fixed to the rod element 10 or 12 arranged there through the aperture 46 in the material band 4.

Figure 3:
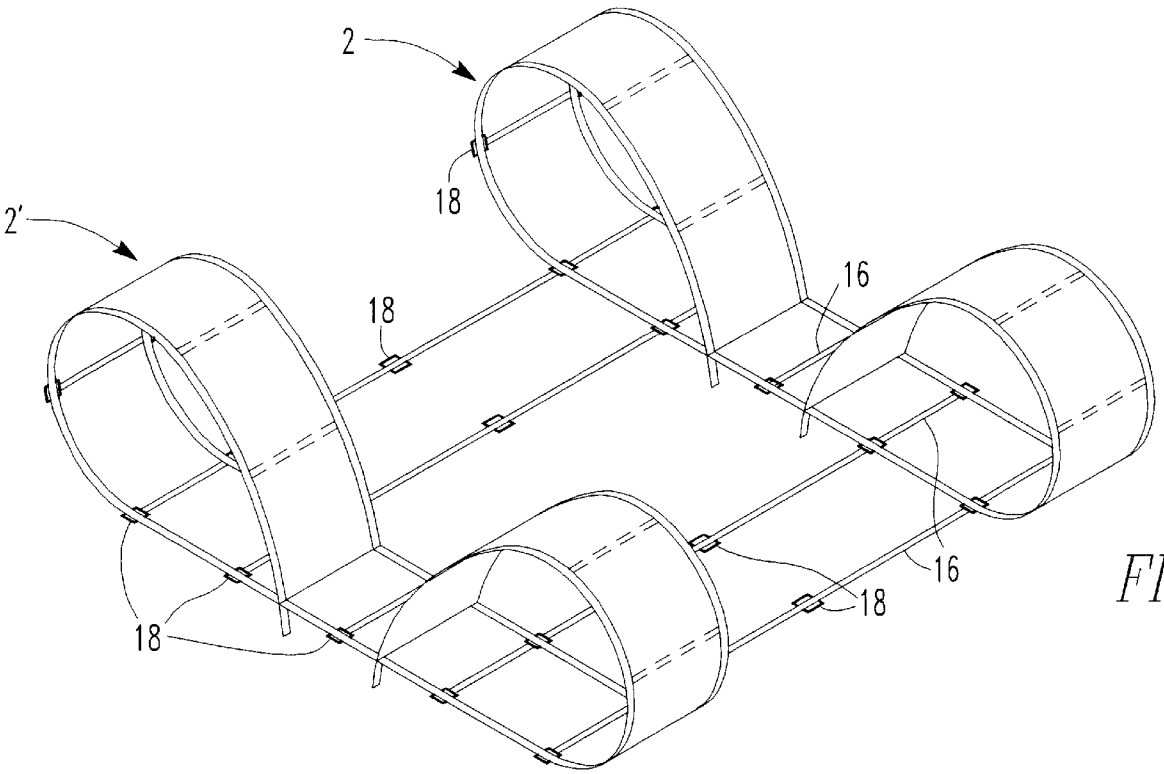
FIG. 3 shows a complex kite made from two base elements of the same shape with a spectacle-shaped secondary structure.

In the exemplary embodiment shown here, two types of apertures are provided: first larger, slit type apertures 46 which are mainly used for the receipt of the connecting elements 18 and second smaller, rounded apertures 48 which are particularly intended for receiving the ends of rod elements 10, 12 (see here particularly FIG. 3).

Figure 2:
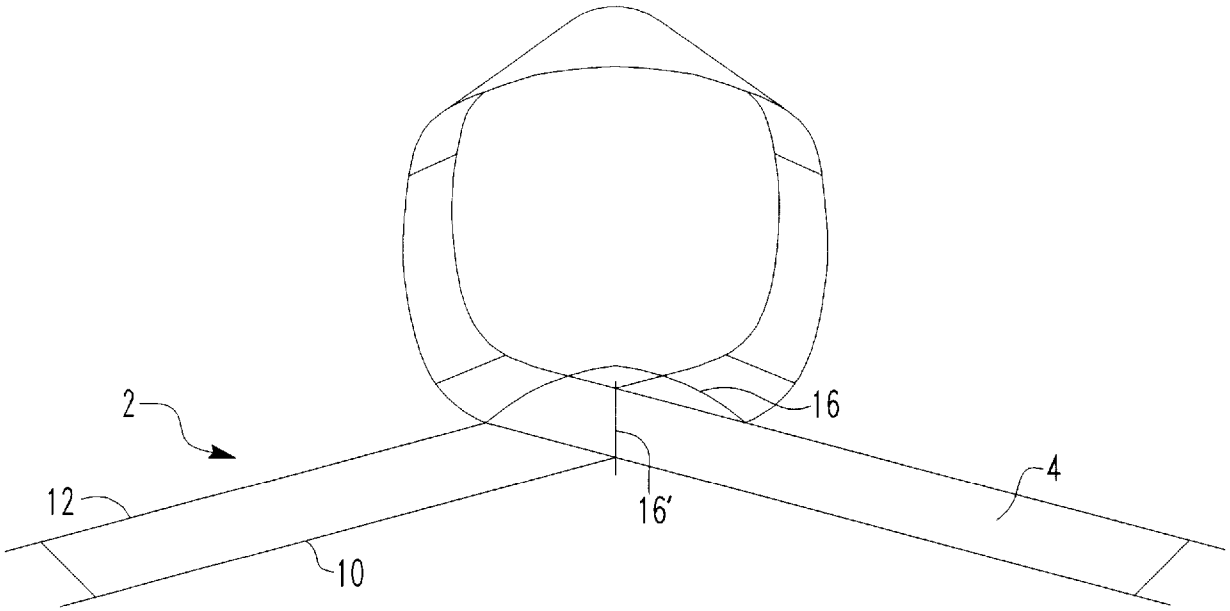
FIG. 2 shows the base element according to FIG. 1, as a loop-type secondary structure.

Using the base element 2 of FIG. 1, a broad range of different kites and/or model gliders can be constructed. FIG. 2 shows for instance, a kite and/or glider model in a loop form, made from one base element 2 and two additional strut elements 16, 16'. The additional strut elements 16, 16' are inserted through apertures in the material band 4 and expediently joined with the help of the connecting elements 18 to the rod elements 10, 12 of the base element 2. However, they can also be simply tied on. (The apertures and the nature of the connection are not represented in detail in this figure.) The rod elements 10, 12 can also end inside the material band 4.

FIG. 3 shows a kite and/or model glider in the form of a pair of spectacles which consists of 2 base elements 2, 2' and a large number of additional strut elements 16 and connecting elements 18.

Figure 4:
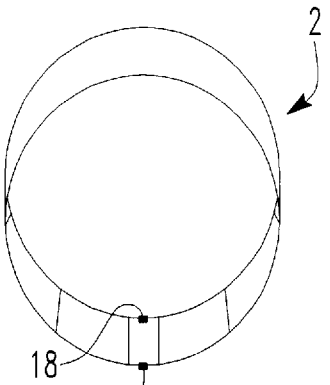
FIG. 4 shows a base element with a tube shaped secondary structure.

FIG. 4 shows a kite and/or model glider in the form of a tube. This model is made from one base element 2 and two additional connecting elements 18, 18'. If connecting elements 18 are used, the two ends of a rod element 10, 12 are inserted in the complementary blind holes 28, 30 (see FIGS. 6–8) of a connecting element 18. In this way, the rod element 10 or 12 is closed to form a ring. Two or more of these tube-shaped kites can be assembled together to make a more complex glider model.

Figure 5:
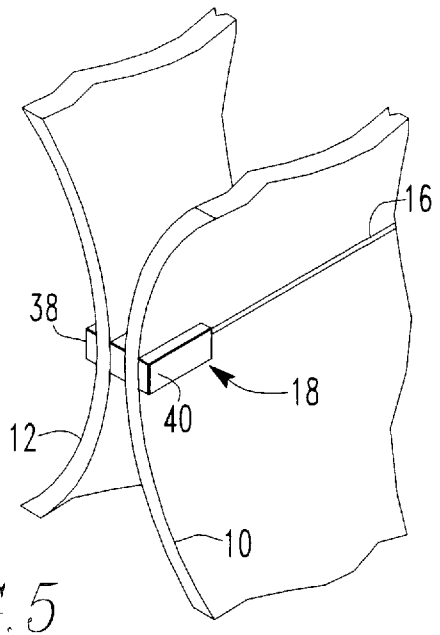
FIG. 5 shows the connection of two base elements with tube shaped secondary structure to form a single more complex kite.

FIG. 5 shows in detail how two tube-shaped kites arranged parallel to one another can be joined together using the connecting elements 18. One tube is stretched directly via the connecting element 18 and the strut element 16, while the second tube is positioned parallel to the strut element 16 and connected via one of the apertures 46.

The kite models shown herein represent particular examples. The number of possible shape variations which can be constructed with the kit according to the invention is extremely large.

What is claimed is:

1. A construction kit for kites and model gliders as well as mobiles and presentation objects and surfaces comprising:

two elastic rod elements, at least one flat, flexible material band provided with receiving structures for receiving said rod elements, at least two strut elements extending between said two rod elements for holding said rod elements apart under tension, and connecting elements for interconnecting said rod elements for extending said rod elements, said connecting elements consisting of an H-shaped component with two parallel longitudinal bars and one crossbar provided with two blind bore holes arranged in a mirror-inverted manner in relation to one another and parallel to said longitudinal bars in which said rod elements or strut elements can be anchored, said two parallel longitudinal bars projecting outwardly to form tongues adapted to grip said rod elements for attaching said strut elements to said rod elements.

2. A construction kit according to claim 1, wherein said flexible material band is essentially oblong in shape.

3. A construction kit according to claim 1, wherein said material band consists of fabric or plastic sheeting.

4. A construction kit according to claim 1, wherein a plurality of eyelets is provided in opposite edge areas of said material band so as to form a receiving structure for said rod elements.

5. A construction kit according to claim 1, wherein pocket-like hem structures are provided at opposite edges of said material band and extend over the entire edge length of the material band for receiving said elastic rod elements.

6. A construction kit according to claim 5, wherein said material band includes apertures formed in said pocket-like hem structures for the receipt of strut elements and connecting elements.

* * * * *